US010928105B2

(12) United States Patent
Ito et al.

(10) Patent No.: US 10,928,105 B2
(45) Date of Patent: Feb. 23, 2021

(54) AIR CONDITIONER

(71) Applicant: Mitsubishi Electric Corporation, Tokyo (JP)

(72) Inventors: Masahiro Ito, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1 day.

(21) Appl. No.: 16/331,167

(22) PCT Filed: Oct. 28, 2016

(86) PCT No.: PCT/JP2016/082124
§ 371 (c)(1),
(2) Date: Mar. 7, 2019

(87) PCT Pub. No.: WO2018/078810
PCT Pub. Date: May 3, 2018

(65) Prior Publication Data
US 2019/0257554 A1 Aug. 22, 2019

(51) Int. Cl.
*F25B 13/00* (2006.01)
*F25B 41/04* (2006.01)

(52) U.S. Cl.
CPC ..... *F25B 13/00* (2013.01); *F25B 41/04* (2013.01); *F25B 2313/0231* (2013.01);
(Continued)

(58) Field of Classification Search
CPC ..... F25B 2313/0273; F25B 2313/0274; F25B 2313/0231; F25B 13/00
See application file for complete search history.

(56) References Cited

U.S. PATENT DOCUMENTS 4,987,747 A * 1/1991 Nakamura ..... F24F 11/83 62/160
5,490,399 A 2/1996 Sada
(Continued)

FOREIGN PATENT DOCUMENTS

CN 102003749 A 4/2011
EP 2295896 A2 3/2011
(Continued)

OTHER PUBLICATIONS

Extended European Search Report dated Aug. 7, 2019 issued in corresponding EP patent application No. 16919859.5.
(Continued)

*Primary Examiner* — Marc E Norman
*Assistant Examiner* — Schyler S Sanks
(74) *Attorney, Agent, or Firm* — Posz Law Group, PLC

(57) ABSTRACT

An air conditioner includes a refrigeration cycle in which a first compressor and a second compressor are connected in parallel, and the first compressor, the second compressor, a first outdoor heat exchanger, a second outdoor heat exchanger, a first indoor heat exchanger, a second indoor heat exchanger, and expansion valves are connected. When the air conditioning apparatus is operated in a first operation mode in which the second outdoor heat exchanger and the first indoor heat exchanger are operated as condensers and the second indoor heat exchanger is operated as an evaporator, refrigerant discharged from the first compressor flows through the first indoor heat exchanger, the expansion valves, and the second indoor heat exchanger in order while bypassing the first outdoor heat exchanger and the second outdoor heat exchanger.

3 Claims, 10 Drawing Sheets

(52) U.S. Cl.
CPC ..... *F25B 2313/0233* (2013.01); *F25B 2313/0252* (2013.01); *F25B 2313/0253* (2013.01); *F25B 2313/02732* (2013.01); *F25B 2313/02742* (2013.01); *F25B 2341/066* (2013.01); *F25B 2400/075* (2013.01); *F25B 2500/31* (2013.01); *F25B 2600/2513* (2013.01); *F25B 2700/2106* (2013.01)

(56) References Cited

U.S. PATENT DOCUMENTS

| | | | | |
|---|---|---|---|---|
| 5,548,968 | A | 8/1996 | Sada | |
| 2011/0048053 | A1* | 3/2011 | Sekine ..... | F25B 13/00 62/324.6 |

FOREIGN PATENT DOCUMENTS

| | | | |
|---|---|---|---|
| JP | H05-001862 | A | 1/1993 |
| JP | 2010-048506 | A | 3/2010 |
| JP | 2010-127504 | A | 6/2010 |
| JP | 2010-127587 | A | 6/2010 |
| JP | 2011-047622 | A | 3/2011 |
| JP | 2015-183898 | A | 10/2015 |

OTHER PUBLICATIONS

International Search Report of the International Searching Authority dated Jan. 24, 2017 for the corresponding International application No. PCT/JP2016/082124 (and English translation).
Office Action dated Jun. 3, 2020 issued in counterpart CN application No. 201680090197.X.
European Office Action dated May 12, 2020 issued in corresponding EP patent application No. 16919859.5.
Communication pursuant to Article 94(3) EPC dated Sep. 11, 2020 issued in corresponding EP patent application No. 16919859.5.

* cited by examiner (a)

(b)

AIR CONDITIONER

CROSS REFERENCE TO RELATED APPLICATION

This application is a U.S. national stage application of International Application PCT/JP2016/082124, filed on Oct. 28, 2016, the contents of which are incorporated herein by reference.

TECHNICAL FIELD

The present invention relates to air conditioners, and more particularly, to an air conditioner configured to perform an operation of causing some indoor heat exchangers of a plurality of indoor heat exchangers to act as condensers and the other indoor heat exchangers to act as evaporators (hereinafter, referred to as simultaneous cooling and heating operation).

BACKGROUND

Air conditioners capable of simultaneous cooling and heating operation have been conventionally known (e.g., see PTL 1). Such an air conditioner determines whether to operate a plurality of indoor heat exchangers in a cooling cycle or a heating cycle in accordance with an operation load.

The air conditioning apparatus described in PTL 1 connects an indoor heat exchanger and an outdoor heat exchanger, each of which acts as a condenser, in parallel to the discharge side of a compressor during cooling-based operation in which the cooling load of the whole of the plurality of indoor heat exchangers is higher than the heating load thereof. In this case, part of the refrigerant discharged from the compressor flows through the indoor heat exchanger acting as a condenser, and the rest of the refrigerant flows through the outdoor heat exchanger acting as a condenser and then flows through the indoor heat exchanger acting as an evaporator.

PATENT LITERATURE

PTL 1: Japanese Patent Laying-Open No. 2010-127504

In the air conditioning apparatus, thus, the compression ratio of the compressor during cooling-based operation depends on an operation condition (e.g., indoor setting temperature) set for the indoor heat exchanger acting as a condenser.

The air conditioning apparatus accordingly suffers from a decrease in operation efficiency caused by an increasing temperature difference between outdoor air or water and refrigerant in the outdoor heat exchanger acting as a condenser during cooling-based operation on a condition (hereinafter, also merely referred to as a low outdoor temperature condition) that the outdoor air temperature (hereinafter, also merely referred to as an outdoor temperature) where the outdoor heat exchanger is placed is lower than the temperature of a medium to be subjected to heat exchange with refrigerant in the indoor heat exchanger acting as a condenser.

SUMMARY

The present invention has been made to solve the above problem. A main object of the present invention is to provide an air conditioner having high operation efficiency during cooling-based operation on a low outdoor temperature condition.

An air conditioner according to the present invention is an air conditioner configured to perform a simultaneous cooling and heating operation. The air conditioner includes a refrigeration cycle having a refrigerant circuit in which a first compressor and a second compressor are connected in parallel, and the first compressor, the second compressor, a first outdoor heat exchanger, a second outdoor heat exchanger, a first indoor heat exchanger, a second indoor heat exchanger, and an expansion valve are connected by pipelines. When the air conditioner is operated in a first operation mode in which the second outdoor heat exchanger and the first indoor heat exchanger are operated as condensers, refrigerant discharged from the first compressor flows through the first indoor heat exchanger, the expansion valve, and the second indoor heat exchanger in order while bypassing the first outdoor heat exchanger and the second outdoor heat exchanger. Refrigerant discharged from the second compressor flows through the second outdoor heat exchanger and then flows through the second indoor heat exchanger while bypassing the first indoor heat exchanger.

The present invention can provide an air conditioner having high operation efficiency during cooling-based operation on a low outdoor temperature condition by being operated in the first operation mode on a low outdoor temperature condition that the outdoor air temperature where the first outdoor heat exchanger is placed is lower than a threshold.

DETAILED DESCRIPTION

Figure 1:
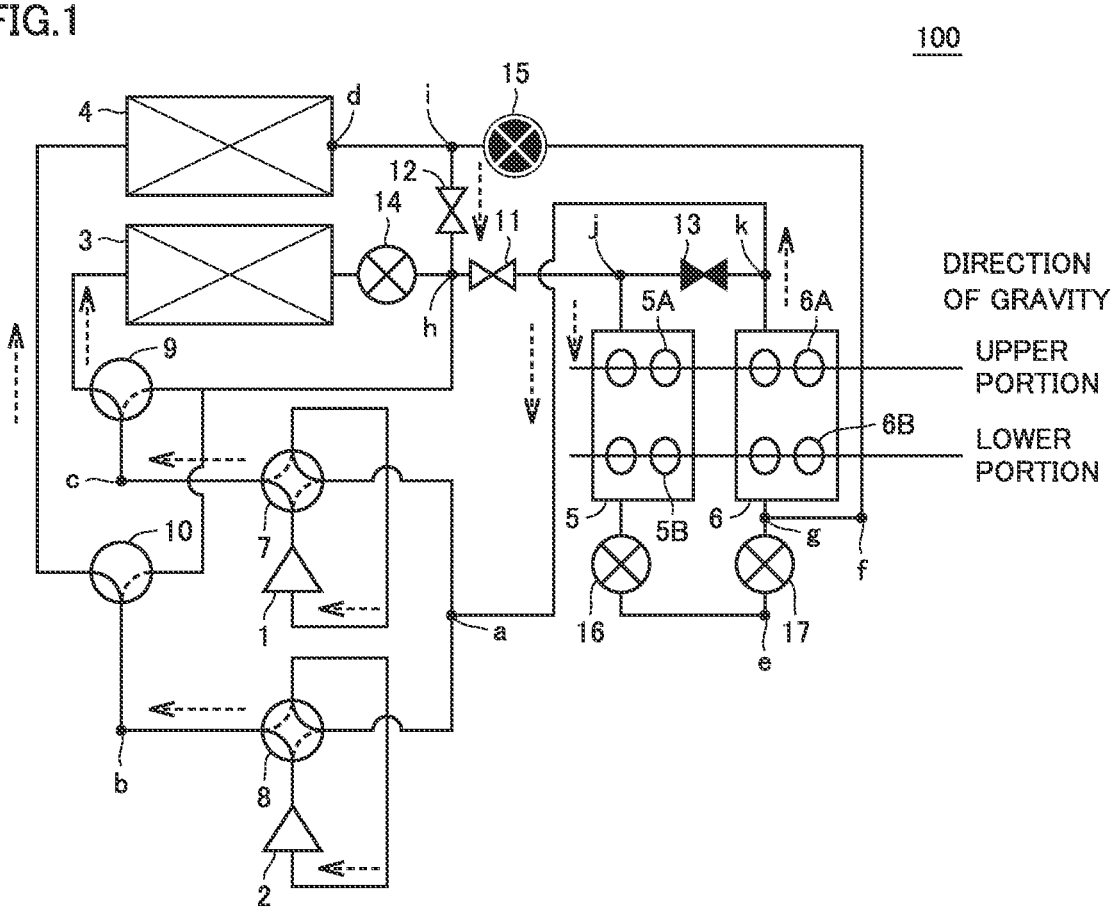
FIG. 1 shows a configuration of a refrigerant circuit in a first state during cooling-based operation of an air conditioner according to Embodiment 1.

Embodiments of the present invention will be described below in detail with reference to the drawings. In the drawings described hereinafter, identical or corresponding parts are identically denoted, and description thereof will not be repeated.

Embodiment 1

[Configuration of Air Conditioner]

An air conditioner 100 according to Embodiment 1 will be described with reference to FIG. 1. Air conditioner 100 is capable of simultaneous cooling and heating operation. Air conditioner 100 mainly includes a first compressor 1 and a second compressor 2, a first outdoor heat exchanger 3 and a second outdoor heat exchanger 4, a first indoor heat exchanger 5 and a second indoor heat exchanger 6, a first four-way valve 7 and a second four-way valve 8, a first three-way valve 9 (switch mechanism), a second three-way valve 10, a first solenoid valve 11, a second solenoid valve 12 (first valve), a first expansion valve 15 (second valve), a second expansion valve 14 (third valve), a third expansion valve 16, and a fourth expansion valve 17. First compressor 1 and second compressor 2, first outdoor heat exchanger 3 and second outdoor heat exchanger 4, first indoor heat exchanger 5 and second indoor heat exchanger 6, first four-way valve 7 and second four-way valve 8, first three-way valve 9, second three-way valve 10, first solenoid valve 11, second solenoid valve 12, first expansion valve 15, second expansion valve 14, third expansion valve 16, and fourth expansion valve 17 are connected as described below to constitute a refrigeration cycle.

First compressor 1 and second compressor 2 are connected in parallel to each other with respect to first indoor heat exchanger 5 and second indoor heat exchanger 6. First compressor 1 has a suction side at which refrigerant is sucked and a discharge side at which refrigerant is discharged, which are connected to different ports of first four-way valve 7. In first compressor 1, one of the suction side and the discharge side is connected through first four-way valve 7 to first three-way valve 9, and the other side is connected through first four-way valve 7 to second indoor heat exchanger 6.

Second compressor 2 has a suction side at which refrigerant is sucked and a discharge side at which refrigerant is discharged, which are connected to different ports of second four-way valve 8. In second compressor 2, one of the suction side and the discharge side is connected through second four-way valve 8 to second three-way valve 10, and the other side is connected through second four-way valve 8 to second indoor heat exchanger 6.

First outdoor heat exchanger 3 and second outdoor heat exchanger 4 are, for example, air-heat exchangers that perform heat exchange between air and refrigerant. First outdoor heat exchanger 3 and second outdoor heat exchanger 4 each have a refrigerant flow path provided therein. First outdoor heat exchanger 3 and second outdoor heat exchanger 4 each have at least two refrigerant inlets/outlets as one end and the other end of the refrigerant flow path.

Refrigerant flows from one refrigerant inlet/outlet of the two refrigerant inlets/outlets and flows out from the other refrigerant inlet/outlet. The directions of refrigerant flowing through first outdoor heat exchanger 3 and second outdoor heat exchanger 4 differ depending on the operation mode of air conditioner 100. A refrigerant inlet/outlet, through which refrigerant flows into first outdoor heat exchanger 3 and second outdoor heat exchanger 4 during cooling-based operation in which second outdoor heat exchanger 4 alone or both of first outdoor heat exchanger 3 and second outdoor heat exchanger 4 are operated as condensers, is hereinafter merely referred to as an inflow side. A refrigerant inlet/outlet, through which refrigerant flows out of first outdoor heat exchanger 3 and second outdoor heat exchanger 4 during cooling-based operation, is hereinafter merely referred to as an outflow side. First outdoor heat exchanger 3 acts as a condenser in a first state (second operation mode) during cooling-based operation described below. First outdoor heat exchanger 3 does not act as a heat exchanger in a second state (first operation mode) during cooling-based operation described below. Second outdoor heat exchanger 4 acts as a condenser in the first state and the second state during cooling-based operation described below.

First indoor heat exchanger 5 and second indoor heat exchanger 6 are, for example, water-heat exchangers that perform heat exchange between water and refrigerant. First indoor heat exchanger 5 and second indoor heat exchanger 6 each have a refrigerant flow path provided therein. As one end and the other end of the refrigerant flow path, first indoor heat exchanger 5 has a refrigerant inlet/outlet 5A and a refrigerant inlet/outlet 5B located in an upper portion and a lower portion, respectively, in the direction of gravity, and second indoor heat exchanger 6 has a refrigerant inlet/outlet 6A and a refrigerant inlet/outlet 6B located in an upper portion and a lower portion, respectively, in the direction of gravity. First indoor heat exchanger 5 and second indoor heat exchanger 6 are provided as follows: when they act as condensers, refrigerant flows in from refrigerant inlets/outlets 5A and 6A located in the upper portion in the direction of gravity and flows out from refrigerant inlets/outlets 5B and 6B located in the lower portion in the direction of gravity, and when they act as evaporators, refrigerant flows in from refrigerant inlets/outlets 5B and 6B located in the lower portion in the direction of gravity and flows out from refrigerant inlets/outlets 5A and 6A located in the upper portion in the direction of gravity. Each of first indoor heat exchanger 5 and second indoor heat exchanger 6 can operate independently as a condenser or an evaporator. First indoor heat exchanger 5 acts as a condenser during cooling-based operation. Second indoor heat exchanger 6 acts as an evaporator during cooling-based operation.

First four-way valve 7 has a port connected to the suction side of first compressor 1, a port connected to the discharge side of first compressor 1, a port connected to first three-way valve 9, and a port connected to refrigerant inlet/outlet 6A of second indoor heat exchanger 6. First four-way valve 7 is configured to switch between the state in which the suction side of first compressor 1 is connected to refrigerant inlet/outlet 6A of second indoor heat exchanger 6 and the discharge side of first compressor 1 is connected to first three-way valve 9, and the state in which the suction side of first compressor 1 is connected to first three-way valve 9 and the discharge side of first compressor 1 is connected to refrigerant inlet/outlet 6A of second indoor heat exchanger 6.

Second four-way valve 8 has a port connected to the suction side of second compressor 2, a port connected to the discharge side of second compressor 2, a port connected to second three-way valve 10, and a port connected to refrigerant inlet/outlet 6A of second indoor heat exchanger 6. Second four-way valve 8 is configured to switch between the state in which the suction side of second compressor 2 is connected to refrigerant inlet/outlet 6A of second indoor heat exchanger 6 and the discharge side of second compressor 2 is connected to second three-way valve 10, and the state in which the suction side of second compressor 2 is connected to second three-way valve 10 and the discharge side of second compressor 2 is connected to refrigerant inlet/outlet 6A of second indoor heat exchanger 6.

First three-way valve 9 has a port connected through first four-way valve 7 to the suction side or the discharge side of first compressor 1, a port connected to the inflow side of first outdoor heat exchanger 3 during cooling-based operation and during cooling-dedicated operation, and a port connected to refrigerant inlet/outlet 5A of first indoor heat exchanger 5. First three-way valve 9 is configured to switch between the state in which the suction side or the discharge side of first compressor 1 is connected to the inflow side of first outdoor heat exchanger 3, and the state in which the suction side or the discharge side of first compressor 1 is connected to refrigerant inlet/outlet 5A of first indoor heat exchanger 5. In other words, first three-way valve 9 is configured to switch between a refrigerant flow formed in the first state from first compressor 1 to first outdoor heat exchanger 3 and a refrigerant flow formed in the second state from first compressor 1 to first indoor heat exchanger 5.

Second three-way valve 10 has a port connected through second four-way valve 8 to the suction side or the discharge side of second compressor 2, a port connected to second outdoor heat exchanger 4, and a port connected to first indoor heat exchanger 5. Second three-way valve 10 is configured to switch between the state in which the suction side or the discharge side of second compressor 2 is connected to second outdoor heat exchanger 4, and the state in which the suction side or the discharge side of second compressor 2 is connected to first indoor heat exchanger 5.

First solenoid valve 11 is configured to open and close the refrigerant flow path provided between the outflow side of first outdoor heat exchanger 3, and refrigerant inlet/outlet 5B of first indoor heat exchanger 5 and refrigerant inlet/outlet 6B of second indoor heat exchanger 6. First solenoid valve 11 is further configured to open and close the refrigerant flow path provided between the outflow side of second outdoor heat exchanger 4, and refrigerant inlet/outlet 5A of first indoor heat exchanger 5 and refrigerant inlet/outlet 6A of second indoor heat exchanger 6. Second solenoid valve 12 is configured to open and close the refrigerant flow path provided between second outdoor heat exchanger 4 and first solenoid valve 11. Second solenoid valve 12 is configured to stop a refrigerant flow formed in the first state from second outdoor heat exchanger 4 to first indoor heat exchanger 5.

First expansion valve 15 is configured to open and close the refrigerant flow path provided between the outflow side of first outdoor heat exchanger 3, and refrigerant inlet/outlet 5B of first indoor heat exchanger 5 and refrigerant inlet/outlet 6B of second indoor heat exchanger 6. First expansion valve 15 is further configured to open and close the refrigerant flow path provided between the outflow side of second outdoor heat exchanger 4, and refrigerant inlet/outlet 5B of first indoor heat exchanger 5 and refrigerant inlet/outlet 6B of second indoor heat exchanger 6. First expansion valve 15 is configured to stop a refrigerant flow formed in the second state from second outdoor heat exchanger 4 to second indoor heat exchanger 6. First expansion valve 15, whose degree of opening can be controlled appropriately, can decompress and expand refrigerant at any appropriate degree of opening except for during fully opened and during fully closed.

Second expansion valve 14 is configured to open and close the refrigerant flow path formed between the outflow side of first outdoor heat exchanger 3, and refrigerant inlet/outlet 5A of first indoor heat exchanger 5 and refrigerant inlet/outlet 6A of second outdoor heat exchanger 4. Second expansion valve 14 is further configured to open and close the refrigerant flow path formed between the outflow side of first outdoor heat exchanger 3, and refrigerant inlet/outlet 5B of first indoor heat exchanger 5 and refrigerant inlet/outlet 6B of second outdoor heat exchanger 4. Second expansion valve 14 is configured to stop a refrigerant flow formed in the first state from first outdoor heat exchanger 3 to first indoor heat exchanger 5.

Third expansion valve 16 and fourth expansion valve 17 are configured to open and close, in the refrigerant flow path provided between refrigerant inlet/outlet 5B of first indoor heat exchanger 5 and refrigerant inlet/outlet 6B of second indoor heat exchanger 6, the refrigerant flow path provided between the outflow side of first outdoor heat exchanger 3 and refrigerant inlet/outlet 5B of first indoor heat exchanger 5 and the refrigerant flow path provided between the outflow side of second outdoor heat exchanger 4 and refrigerant inlet/outlet 5B of first indoor heat exchanger 5. Third expansion valve 16 and fourth expansion valve 17, whose degrees of opening can be controlled appropriately, can decompress and expand refrigerant at any appropriate degree of opening except for during fully opened and during fully closed. During cooling-based operation, for example, third expansion valve 16 is fully opened, and the degree of opening of fourth expansion valve 17 is adjusted. Consequently, during cooling-based operation, the refrigerant flowing through the refrigerant flow path provided between refrigerant inlet/outlet 5B of first indoor heat exchanger 5 and refrigerant inlet/outlet 6B of second indoor heat exchanger 6 is decompressed and expanded.

During cooling-based operation, first outdoor heat exchanger 3, second outdoor heat exchanger 4, first indoor heat exchanger 5, and second indoor heat exchanger 6 are connected as follows. The discharge side of first compressor 1 is connected through first four-way valve 7 and first three-way valve 9 to the inflow side of first outdoor heat exchanger 3 and is also connected through first four-way valve 7, first three-way valve 9, and first solenoid valve 11 to refrigerant inlet/outlet 5A of first indoor heat exchanger 5. The discharge side of second compressor 2 is connected through second four-way valve 8 and second three-way valve 10 to the inflow side of second outdoor heat exchanger 4 and is also connected through second four-way valve 8, second three-way valve 10, and first solenoid valve 11 to refrigerant inlet/outlet 5A of first indoor heat exchanger 5. The outflow side of first outdoor heat exchanger 3 is connected through second expansion valve 14 and first solenoid valve 11 to refrigerant inlet/outlet 5A of first indoor heat exchanger 5. The outflow side of second outdoor heat exchanger 4 is connected through first solenoid valve 11 and second solenoid valve 12 to refrigerant inlet/outlet 5A of first indoor heat exchanger 5 and is also connected through first expansion valve 15 to refrigerant inlet/outlet 6B of second indoor heat exchanger 6.

For example, the refrigerant flow path between the discharge side of first compressor 1 and refrigerant inlet/outlet 5A of first indoor heat exchanger 5 is connected to partially overlap the refrigerant flow path between the outflow side of first outdoor heat exchanger 3 and refrigerant inlet/outlet 5A of first indoor heat exchanger 5. Second expansion valve 14 is configured to open and close a portion of the refrigerant flow path between the outflow side of first outdoor heat exchanger 3 and refrigerant inlet/outlet 5A of first indoor heat exchanger 5, which does not overlap the refrigerant flow path between the discharge side of first compressor 1 and refrigerant inlet/outlet 5A of first indoor heat exchanger 5. From a different perspective, second expansion valve 14 is provided between the outflow side of first outdoor heat exchanger 3 and a four-branch point h, which will be described below. Second expansion valve 14, whose degree of opening can be controlled appropriately, can decompress and expand refrigerant at any appropriate degree of opening except for during fully opened and during fully closed.

Figure 3:
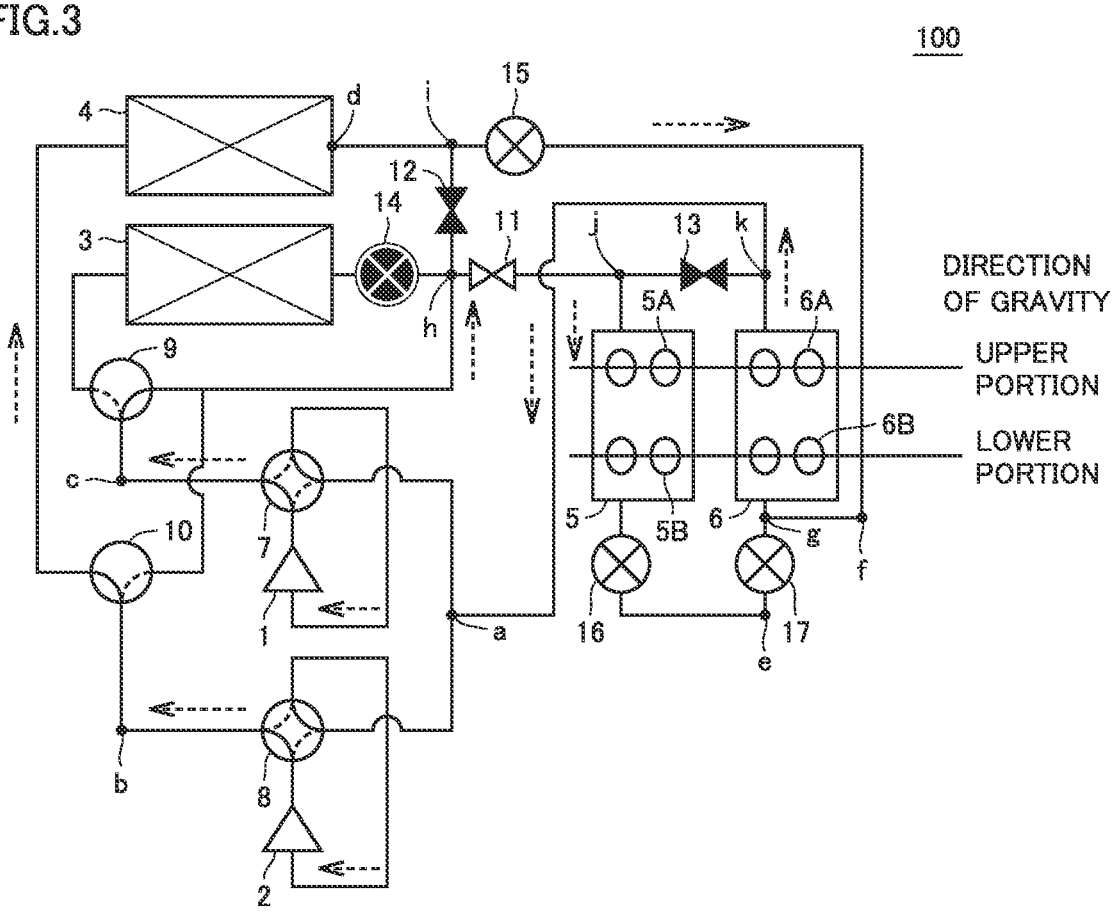
FIG. 3 shows a configuration of the refrigerant circuit in a second state during cooling-based operation of the air conditioner according to Embodiment 1.

Air conditioner 100 is configured to switch between the first state and the second state during cooling-based operation in which second outdoor heat exchanger 4 is operated as a condenser, first indoor heat exchanger 5 acts as a condenser, and second indoor heat exchanger 6 acts as an evaporator. The first state is selected when the outdoor air temperature (outdoor temperature) where first outdoor heat exchanger 3 is placed is higher than or equal to a predetermined set temperature. The second state is selected when the outdoor temperature is lower than the predetermined set temperature (described below in detail). As shown in FIG. 1, in the first state, first compressor 1 and first outdoor heat exchanger 3 are connected through first three-way valve 9, first expansion valve 15 is closed, and first solenoid valve 11, second solenoid valve 12, and second expansion valve 14 are opened. As shown in FIG. 3, in the second state, first compressor 1 and first indoor heat exchanger 5 are connected through first three-way valve 9, first solenoid valve 11 and first expansion valve 15 are opened, and second solenoid valve 12 and second expansion valve 14 are closed.

In air conditioner 100 in the first state, first compressor 1, first four-way valve 7, first three-way valve 9, first outdoor heat exchanger 3, second expansion valve 14, first solenoid valve 11, first indoor heat exchanger 5, third expansion valve 16, fourth expansion valve 17, and second indoor heat exchanger 6 are connected in series in order. Further, in air conditioner 100 in the first state, second compressor 2, second four-way valve 8, second three-way valve 10, second outdoor heat exchanger 4, second solenoid valve 12, first solenoid valve 11, first indoor heat exchanger 5, third expansion valve 16, fourth expansion valve 17, and second indoor heat exchanger 6 are connected in series in order. In the first state, a refrigerant flow from first outdoor heat exchanger 3 to first indoor heat exchanger 5 is stopped. In the first state, a refrigerant flow from second outdoor heat exchanger 4 to first indoor heat exchanger 5 is stopped.

In air conditioner 100 in the second state, first compressor 1, first four-way valve 7, first three-way valve 9, first solenoid valve 11, first indoor heat exchanger 5, third expansion valve 16, fourth expansion valve 17, and second indoor heat exchanger 6 are connected in series in order. Further, in air conditioner 100 in the second state, second compressor 2, second four-way valve 8, second three-way valve 10, second outdoor heat exchanger 4, first expansion valve 15, and second indoor heat exchanger 6 are connected in series in order. That is to say, in the first state, the refrigerant discharged from first compressor 1 flows through first outdoor heat exchanger 3, second expansion valve 14, first solenoid valve 11, first indoor heat exchanger 5, third expansion valve 16, fourth expansion valve 17, and second indoor heat exchanger 6 in order. In the first state, the refrigerant discharged from second compressor 2 flows through second outdoor heat exchanger 4, second solenoid valve 12, first solenoid valve 11, first indoor heat exchanger 5, third expansion valve 16, fourth expansion valve 17, and second indoor heat exchanger 6 in order. In the second state, the refrigerant discharged from first compressor 1 also flows through first solenoid valve 11, first indoor heat exchanger 5, third expansion valve 16, fourth expansion valve 17, and second indoor heat exchanger 6 in order while bypassing first outdoor heat exchanger 3 and second outdoor heat exchanger 4. In the second state, the refrigerant discharged from the second compressor flows through second outdoor heat exchanger 4 and then flows through first expansion valve 15 and second indoor heat exchanger 6 in order while bypassing first indoor heat exchanger 5. In the second state, a refrigerant flow from first outdoor heat exchanger 3 to first indoor heat exchanger 5 is stopped. In the second state, a refrigerant flow from second outdoor heat exchanger 4 to first indoor heat exchanger 5 is stopped.

Air conditioner 100 is switched between the first state and the second state during cooling-based operation, based on the temperature of water (medium) subjected to heat exchange with refrigerant in first indoor heat exchanger 5 and the outdoor air temperature (outdoor temperature) where first outdoor heat exchanger 3 is placed. The water temperature and outdoor temperature can be measured by any appropriate method. The water temperature is measured by, for example, a temperature sensor (not shown) provided at the water inlet/outlet in first indoor heat exchanger 5. The outdoor temperature is measured by, for example, a temperature sensor (not shown) provided together in first outdoor heat exchanger 3.

During cooling-based operation, air conditioner 100 maintains the first state when the outdoor temperature where first outdoor heat exchanger 3 is placed is higher than or equal to a predetermined set value. During cooling-based operation, air conditioner 100 maintains the second state on the low outdoor temperature condition that the outdoor temperature where first outdoor heat exchanger 3 is placed is lower than the set value. The set value of the outdoor temperature which is set in advance is lower than the temperature of water (medium) subjected to heat exchange with refrigerant in first indoor heat exchanger 5. In the first state, air conditioner 100 is switched to the second state when the outdoor temperature where first outdoor heat exchanger 3 is placed is lower than the set value. In the second state, air conditioner 100 is switched to the first state when the outdoor temperature where first outdoor heat exchanger 3 is placed is higher than or equal to the set value.

[Function and Effect]

Air conditioner 100 having such a configuration can directly supply the refrigerant discharged from first compressor 1 to first indoor heat exchanger 5 acting as a condenser by achieving the second state on the condition that the outdoor temperature is lower than or equal to the set value which is lower than the water temperature during cooling-based operation. At this time, in air conditioner 100, the refrigerant discharged from second compressor 2 flows through second outdoor heat exchanger 4 acting as a condenser and is then supplied to second indoor heat exchanger 6 acting as an evaporator while bypassing first indoor heat exchanger 5 acting as a condenser. This causes air conditioner 100 to operate first compressor 1 alone at a high compression ratio and operate second compressor 2 at a low compression ratio during cooling-based operation on the low outdoor temperature condition. Air conditioner 100 thus has a more improved operation efficiency during cooling-based operation on the low outdoor temperature condition than that of a conventional air conditioner in which part of the refrigerant discharged from the same compressor is supplied to the indoor heat exchanger acting as a condenser and the rest thereof flows through the outdoor heat exchanger acting as a condenser and is supplied to the indoor heat exchanger acting as an evaporator during cooling-based operation on the low outdoor temperature condition.

Air conditioner 100 preferably switches between the first state and the second state based on the temperature of a medium which is subjected to heat exchange with refrigerant in first indoor heat exchanger 5 and the outdoor air temperature where first outdoor heat exchanger 3 is placed. Air conditioner 100 more preferably switches from the first state to the second state when the outdoor air temperature where first outdoor heat exchanger 3 is placed is lower than a set value during cooling-based operation. The set value is lower than the temperature of the medium which is subjected to heat exchange with refrigerant in first indoor heat exchanger 5.

Figure 2:
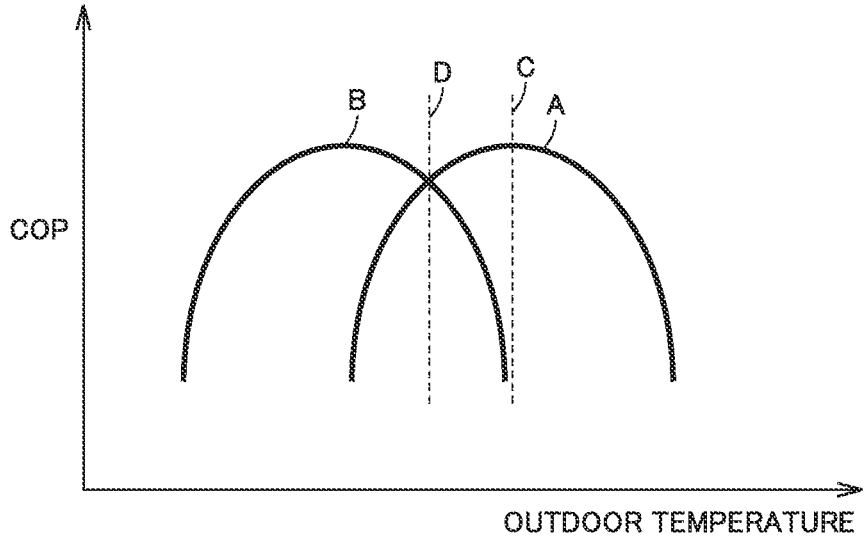
FIG. 2(*a*) is a graph showing a relationship between a coefficient of performance and an outdoor temperature during cooling-based operation of the air conditioner according to Embodiment 1, and FIG. 2(*b*) is a pressure-enthalpy (P-h) diagram showing a cycle operation during cooling-based operation of the air conditioner according to Embodiment 1.
Figure 2:
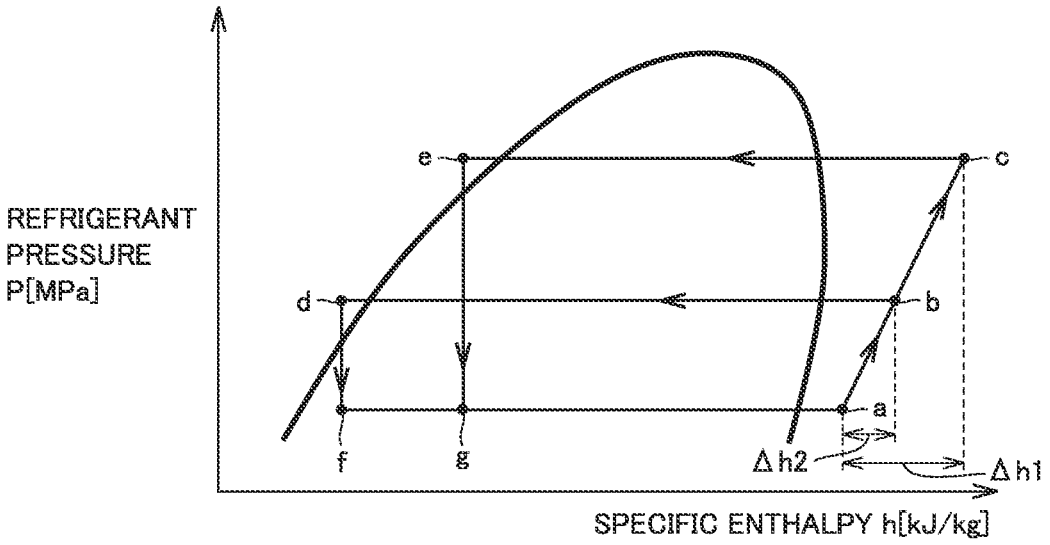

The present inventors have confirmed that air conditioner 100 has the following operation efficiency during cooling-based operation on the low outdoor temperature condition. FIG. 2(*a*) is a graph showing a relationship between a coefficient of performance (COP) and an outdoor temperature during cooling-based operation of air conditioner 100. In FIG. 2(*a*), the vertical axis represents COP during cooling-based operation, and the horizontal axis represents outdoor temperature. In FIG. 2(*a*), a curve A represents COP obtained when the refrigerant circuit in the first state is configured in which first outdoor heat exchanger 3 and second outdoor heat exchanger 4 are used as condensers, and a curve B represents COP obtained when the refrigerant circuit in the second state is configured in which first outdoor heat exchanger 3 is not caused to function and second outdoor heat exchanger 4 alone is used as a condenser. When the outdoor temperature has a predetermined value D (see FIG. 2(*a*)) lower than the temperature of the water which is subjected to heat exchange with refrigerant in first indoor heat exchanger 5, the COP (curve A) of the air conditioner in the first state in which first outdoor heat exchanger 3, second outdoor heat exchanger 4, and first indoor heat exchanger 5 are used as condensers is equal to the COP (curve B) of the air conditioner in the second state in which second outdoor heat exchanger 4 and first indoor heat exchanger 5 are used as condensers. When the outdoor temperature is lower than the predetermined value D, the COP of air conditioner 100 in the second state is higher than the COP of air conditioner 100 in the first state. When the outdoor temperature exceeds the predetermined value, the COP of air conditioner 100 in the first state is higher than the COP of air conditioner 100 in the second state. Thus, in air conditioner 100, the predetermined value is preferably set as the set value serving as a reference for switching between the first state and the second state. That is to say, air conditioner 100 is preferably configured to enter the first state when the outdoor temperature is higher than or equal to the predetermined value or exceeds the predetermined value and enter the second state when the outdoor temperature is lower than the predetermined value or is lower than or equal to the predetermined value. This allows air conditioner 100 to have an increased operation efficiency during refrigerant-based operation also on the low outdoor temperature condition and also on a high outdoor temperature condition that the outdoor temperature exceeds the water temperature.

Although air conditioner 100 includes second expansion valve 14 between first outdoor heat exchanger 3 and first indoor heat exchanger 5, it can perform the above operation and achieve the above effects without second expansion valve 14. When first outdoor heat exchanger 3 and second outdoor heat exchanger 4 are air-heat exchangers that perform heat exchange between air and refrigerant, however, it is preferable that air conditioner 100 further include second expansion valve 14 between first outdoor heat exchanger 3 and first indoor heat exchanger 5. Second expansion valve 14 is open in the first state and is closed in the second state. In the first state, first compressor 1, first three-way valve 9, first outdoor heat exchanger 3, second expansion valve 14, first indoor heat exchanger 5, and second indoor heat exchanger 6 are connected in series in order.

Consequently, closing second expansion valve 14 in the second state can prevent the refrigerant discharged from first compressor 1 from seeping from the outflow side into first outdoor heat exchanger 3 which is in the nonoperating status in the second state and from accumulating at the bottom thereof (stagnation of refrigerant). Air conditioner 100 is accordingly prevented from having a decreased circulation amount of refrigerant associated with the stagnation of refrigerant also in the second state, thereby being preventing from having decreased air conditioning performance Air conditioner 100 may include no second three-way valve 10. Second four-way valve 8 may be connected to second outdoor heat exchanger 4 while bypassing second three-way valve 10. This also allows air conditioner 100 to switch between the first state and the second state by first three-way valve 9, second solenoid valve 12, first expansion valve 15, and second expansion valve 14.

Specific Example

A specific example of air conditioner 100 will now be described. As shown in FIG. 1, the refrigerant flow path formed between refrigerant inlet/outlet 6A of second indoor heat exchanger 6, and the suction side of first compressor 1 and the suction side of second compressor 2 is branched at a branch point a (see FIG. 1) into a refrigerant flow path formed between the suction side of first compressor 1 and refrigerant inlet/outlet 6A of second indoor heat exchanger 6 through first four-way valve 7 and a refrigerant flow path formed between the suction side of second compressor 2 and refrigerant inlet/outlet 6A of second indoor heat exchanger 6 through second four-way valve 8.

Air conditioner 100 has a refrigerant pipe branched into, for example, four parts. Branch point h of the four-branch pipe is provided between second expansion valve 14 and first solenoid valve 11 in the refrigerant flow path formed between the outflow side of first outdoor heat exchanger 3 and refrigerant inlet/outlet 5A of first indoor heat exchanger 5. Branch point h is provided between first solenoid valve 11 and second solenoid valve 12 in the refrigerant flow path formed between the outflow side of second outdoor heat exchanger 4 and refrigerant inlet/outlet 5A of first indoor heat exchanger 5. Branch point h is provided between first three-way valve 9 and second solenoid valve 12 in the refrigerant flow path formed between first compressor 1 and first indoor heat exchanger 5. In the first state during cooling-based operation, the refrigerant flowing from first outdoor heat exchanger 3 to first indoor heat exchanger 5 and the refrigerant flowing from second outdoor heat exchanger 4 to first indoor heat exchanger 5 circulate through the branch pipe having branch point h. In the second state during cooling-based operation, only the refrigerant flowing from first compressor 1 to first indoor heat exchanger 5 circulates through the branch pipe having branch point h.

Air conditioner 100 has a refrigerant pipe branched into, for example, three parts. A branch point i of the three-branch pipe is provided on second outdoor heat exchanger 4 side not on the first expansion valve 15 side in the refrigerant flow path formed between the outflow side of second outdoor heat exchanger 4 and refrigerant inlet/outlet 6B of second indoor heat exchanger 6. Branch point i is provided between second solenoid valve 12 and first expansion valve 15 in the refrigerant flow path formed between the discharge side of first compressor 1 and refrigerant inlet/outlet 6B of second indoor heat exchanger 6. Second solenoid valve 12 is provided between branch point h and branch point i.

Air conditioner 100 may include no first solenoid valve 11 provided between second outdoor heat exchanger 4 and first indoor heat exchanger 5, and in such a configuration, can perform the above operation and achieve the above effects. It suffices that air conditioner 100 includes at least any one of third expansion valve 16 and fourth expansion valve 17. Also air conditioner 100 including third expansion valve 16 or fourth expansion valve 17 can perform the above operation and achieve the above effects.

Air conditioner 100 preferably further includes a refrigerant flow path provided between the outflow side of first outdoor heat exchanger 3 and refrigerant inlet/outlet 6A of second indoor heat exchanger 6, and a third solenoid valve 13. Third solenoid valve 13 is configured to open and close a refrigerant flow path (a refrigerant flow path located between a branch point j and a branch point k in FIG. 1) which is located between the outflow side of second outdoor heat exchanger 4 and refrigerant inlet/outlet 6A of second indoor heat exchanger 6 and provided between refrigerant inlet/outlet 5A of first indoor heat exchanger 5 and refrigerant inlet/outlet 6A of second indoor heat exchanger 6, in the refrigerant flow path provided between the outflow side of first outdoor heat exchanger 3 and refrigerant inlet/outlet 6A of second indoor heat exchanger 6.

Air conditioner 100 opens second solenoid valve 12, third expansion valve 16, and fourth expansion valve 17 and closes third solenoid valve 13 in the first state and the second state. In this case, air conditioner 100 is connected as follows.

A pressure-enthalpy (P-h) diagram showing a cycle operation during cooling-based operation of air conditioner 100 will now be described with reference to FIGS. 1 to 3. For air conditioner 100 in the first state or the second state, a point a to a point g will be first described with reference to FIGS. 1 and 3. Point a is a point located on the suction side of first compressor 1 and second compressor 2. Point b is a point located on the discharge side of second compressor 2. Point c is a point located on the discharge side of first compressor 1. Point d is a point located on the outflow side of second outdoor heat exchanger 4. Point e is a point located between refrigerant inlet/outlet 5B of first indoor heat exchanger 5 and refrigerant inlet/outlet 6B of second indoor heat exchanger 6 and is located between third expansion valve 16 and fourth expansion valve 17. Point f is a point located between second expansion valve 14 and refrigerant inlet/outlet 6B of second indoor heat exchanger 6. Point g is a point located at refrigerant inlet/outlet 6B of second indoor heat exchanger 6.

FIG. 2(*b*) is a pressure-enthalpy diagram showing a cycle operation in the second state during cooling-based operation of air conditioner 100. In FIG. 2(*b*), the vertical axis represents pressure P (unit:MPa), and the horizontal axis represents specific enthalpy h (unit:kJ/kg). A curve in FIG. 2(*b*) is a saturation vapor line and a saturation line of refrigerant. A point a to a point g shown in FIG. 2(*b*) indicate the pressures and specific enthalpies at point a to point g in FIG. 1. As shown in FIG. 2(*b*), in the second state, air conditioner 100 can make a specific enthalpy difference (a difference between a specific enthalpy on the suction side and a specific enthalpy on the discharge side) Δh1 between upstream and downstream of first compressor 1 lower than a specific enthalpy Δh2 between upstream and downstream of second compressor 2. In air conditioner 100, the specific enthalpy difference of the whole of first compressor 1 and second compressor 2 is Δh1+Δh2

Figure 10:
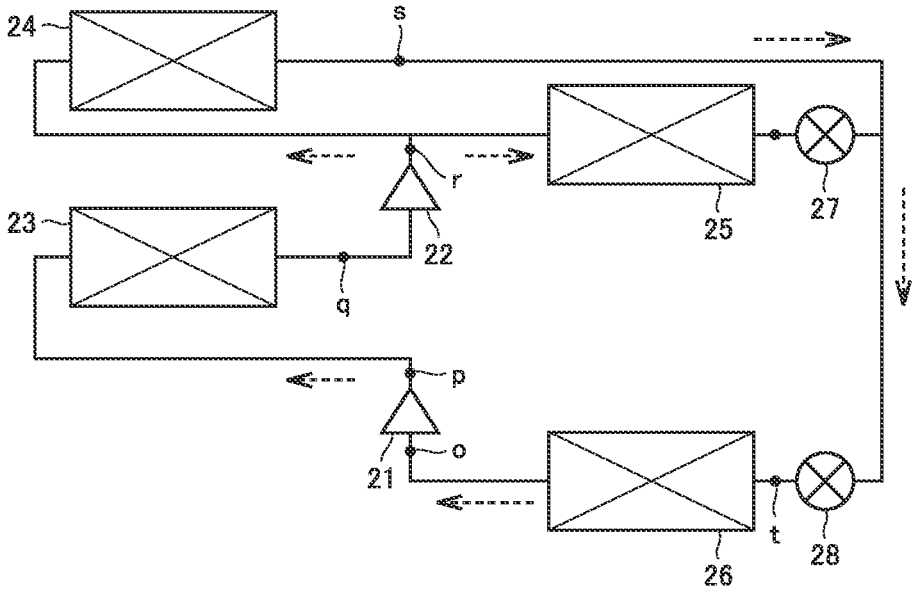
FIG. 10 shows a configuration of a refrigerant circuit of a conventional air conditioner capable of simultaneous cooling and heating operation.

A pressure-enthalpy (P-h) diagram showing a cycle operation during cooling-based operation of a conventional air conditioner will now be described with reference to FIGS. 10 and 11. FIG. 10 shows a configuration of a refrigerant circuit during cooling-based operation of the conventional air conditioner. The conventional air conditioner includes multistage compressors 21 and 22, where the discharge side of compressor 21 at the preceding stage is connected through outdoor heat exchanger 23 to the suction side of compressor 22 at the subsequent stage. The discharge side of compressor 22 at the subsequent stage is connected to the inflow side of outdoor heat exchanger 24 and the inflow side of indoor heat exchanger 25 which act as condensers. The outflow side of indoor heat exchanger 25 is connected through expansion valve 27 and expansion valve 28 to the inflow side of indoor heat exchanger 26 acting as an evaporator. The outflow side of outdoor heat exchanger 24 is connected through expansion valve 28 to the inflow side of indoor heat exchanger 26 acting as an evaporator. That is to say, in the conventional air conditioner, compressor 21, outdoor heat exchanger 23, compressor 22, outdoor heat exchanger 24, expansion valve 28, and indoor heat exchanger 26 are connected in series in order, and compressor 21, outdoor heat exchanger 23, compressor 22, indoor heat exchanger 25, expansion valve 27, expansion valve 28, and indoor heat exchanger 26 are connected in series in order. For such a conventional air conditioner during cooling-based operation, a point o to a point t below will be described. Point o is a point located on the suction side of compressor 21. Point p is a point located at the discharge side of compressor 21. Point q is a point located between the outflow side of outdoor heat exchanger 23 and the suction side of compressor 22. Point r is a point located on the discharge side of compressor 22. Point s is a point located on the outflow side of outdoor heat exchanger 24. Point t is a point located between expansion valve 28 and the inflow side of indoor heat exchanger 26.

Figure 11:
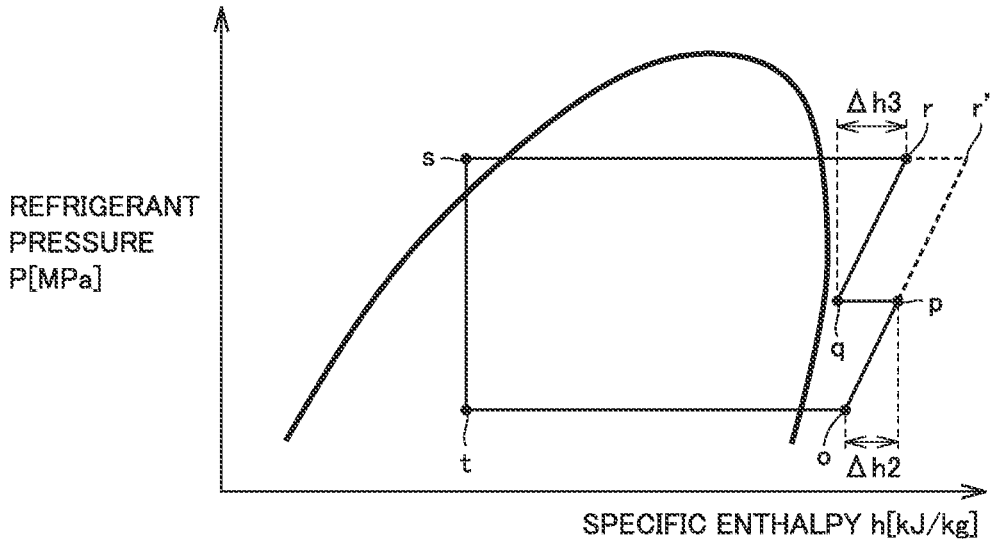
FIG. 11 a pressure-enthalpy (P-h) diagram showing a cycle operation during cooling-based operation of the air conditioner shown in FIG. 10.

FIG. 11 is a pressure-enthalpy diagram showing a cycle operation during cooling-based operation of the conventional air conditioner shown in FIG. 10. The vertical axis in FIG. 11 represents pressure P (unit:MPa), and the horizontal axis in FIG. 11 represents specific enthalpy h (unit:kJ/kg). A point o to a point t shown in FIG. 11 indicate the pressures and specific enthalpies at point o to point t in FIG. 10. As shown in FIG. 11, in the conventional air conditioner, high-temperature, high-pressure refrigerant compressed to be supplied to indoor heat exchanger 25 serving as a condenser is constantly supplied to outdoor heat exchanger 24 during cooling-based operation. The specific enthalpy difference of the whole of compressors 21 and 22 of the conventional air conditioner is thus twice the sum of a specific enthalpy difference Δh3 between upstream and downstream of compressor 21 and a specific enthalpy difference Δh4 between upstream and downstream of compressor 22, that is, 2×(Δh3+Δh4). A point in FIG. 11 indicates the pressure and specific enthalpy at point D when outdoor heat exchanger 23 shown in FIG. 10 does not function.

In comparison between air conditioner 100 and the conventional air conditioner, when the pressure and specific enthalpy of the refrigerant supplied to the indoor heat exchanger (first indoor heat exchanger 5 in FIG. 1 and indoor heat exchanger 25 in FIG. 10) serving as a condenser are equal to those of the refrigerant supplied to the indoor heat exchanger (second indoor heat exchanger 6 in FIG. 1 and indoor heat exchanger 26 in FIG. 10) serving as an evaporator, air conditioner 100 can reduce the workload of second compressor 2 more than the conventional air conditioner while keeping the heat exchange amount in the indoor heat exchanger equal to that of the conventional air conditioner.

As shown in FIGS. 1 to 8, air conditioner 100 may include, for example, refrigerant pipelines provided between the outdoor heat exchanger and the indoor heat exchanger as described below.

A first refrigerant pipeline that can be opened and closed by at least one of second expansion valve 14 and first solenoid valve 11 is provided between the outflow side of first outdoor heat exchanger 3 and refrigerant inlet/outlet 5A of first indoor heat exchanger 5. A second refrigerant pipeline that can be opened ad closed by at least any one of second expansion valve 14, first solenoid valve 11, and third solenoid valve 13 is provided between the outflow side of first outdoor heat exchanger 3 and refrigerant inlet/outlet 6A of second indoor heat exchanger 6. The first refrigerant pipeline and the second refrigerant pipeline have a common portion (a refrigerant pipeline formed between the outflow side of first outdoor heat exchanger 3 and point j) and a noncommon portion (a refrigerant pipeline formed between point j and refrigerant inlet/outlet 6A). Second expansion valve 14 and first solenoid valve 11 are provided at the common portion in the second refrigerant pipeline. Third solenoid valve 13 is provided at the noncommon portion in the second refrigerant pipeline.

A third refrigerant pipeline that can be opened and closed by at least any one of second expansion valve 14, first solenoid valve 11, first expansion valve 15, third expansion valve 16, and fourth expansion valve 17 is provided between the outflow side of first outdoor heat exchanger 3 and refrigerant inlet/outlet 5B of first indoor heat exchanger 5. A fourth refrigerant pipeline that can be opened and closed by at least any one of second expansion valve 14, second solenoid valve 12, and first expansion valve 15 is provided between the outflow side of first outdoor heat exchanger 3 and refrigerant inlet/outlet 6B of second indoor heat exchanger 6. The third refrigerant pipeline and the fourth refrigerant pipeline have a common portion (a refrigerant pipeline formed between the outflow side of first outdoor heat exchanger 3 and point g) and a noncommon portion (a refrigerant pipeline formed between point g and refrigerant inlet/outlet 5B). Second expansion valve 14, second solenoid valve 12, and first expansion valve 15 are provided at the common portion in the third refrigerant pipeline, and third expansion valve 16 and fourth expansion valve 17 are provided at the noncommon portion in the third refrigerant pipeline. The third refrigerant pipeline has a common portion (a refrigerant pipeline formed between the outflow side of first outdoor heat exchanger 3 and point h). Second expansion valve 14 is provided at the common portion in the third refrigerant pipeline.

A fifth refrigerant pipeline that can be opened and closed by at least any one of first solenoid valve 11 and second solenoid valve 12 is provided between the outflow side of second outdoor heat exchanger 4 and refrigerant inlet/outlet 5A of first indoor heat exchanger 5. A sixth refrigerant pipeline that can be opened and closed by at least any one of first solenoid valve 11, second solenoid valve 12, and third solenoid valve 13 is provided between the outflow side of second outdoor heat exchanger 4 and refrigerant inlet/outlet 6A of second indoor heat exchanger 6. The fifth refrigerant pipeline and the sixth refrigerant pipeline have a common portion (a refrigerant pipeline formed between the outflow side of second outdoor heat exchanger 4 and point j) and a noncommon portion (a refrigerant pipeline formed between point j and refrigerant inlet/outlet 6A). First solenoid valve 11 and second solenoid valve 12 are provided at the common portion in the sixth refrigerant pipeline, and third solenoid valve 13 is provided at the noncommon portion in the sixth refrigerant pipeline.

A seventh refrigerant pipeline that can be opened and closed by at least any one of first expansion valve 15, third expansion valve 16, and fourth expansion valve 17 is provided between the outflow side of second outdoor heat exchanger 4 and refrigerant inlet/outlet 5B of first indoor heat exchanger 5. An eighth refrigerant pipeline that can be opened and closed by first expansion valve 15 is provided between the outflow side of second outdoor heat exchanger 4 and refrigerant inlet/outlet 6B of second indoor heat exchanger 6. The seventh refrigerant pipeline and the eighth refrigerant pipeline have a common portion (a refrigerant pipeline formed between the outflow side of second outdoor heat exchanger 4 and point g) and a noncommon portion (a refrigerant pipeline formed between point g and refrigerant inlet/outlet 5B). First expansion valve 15 is provided at the common portion in the seventh refrigerant pipeline, and third expansion valve 16 and fourth expansion valve 17 are provided at the noncommon portion in the seventh refrigerant pipeline. In the first state, the first refrigerant pipeline and the fifth refrigerant pipeline are opened to form a refrigerant flow path. In the second state, the eighth refrigerant pipeline is opened to form a refrigerant flow path. The operations other than the cooling-based operation of air conditioner 100 having the above configuration will now be described with reference to FIGS. 4 to 8. Air conditioner 100 can perform cooling-dedicated operation, heating-based operation, heating-dedicated operation, and full heat recovery operation in addition to cooling-based operation. During the cooling-dedicated operation, all indoor heat exchangers act as evaporators. During the heating-based operation, the heating load of the whole of indoor heat exchangers is higher than the cooling load thereof during the simultaneous cooling and heating operation. During the full heat recovery operation, the outdoor heat exchanger does not perform heat exchange and the indoor heat exchanger alone performs heat exchange, where first indoor heat exchanger 5 acts as a condenser and second indoor heat exchanger 6 acts as an evaporator.

Figure 4:
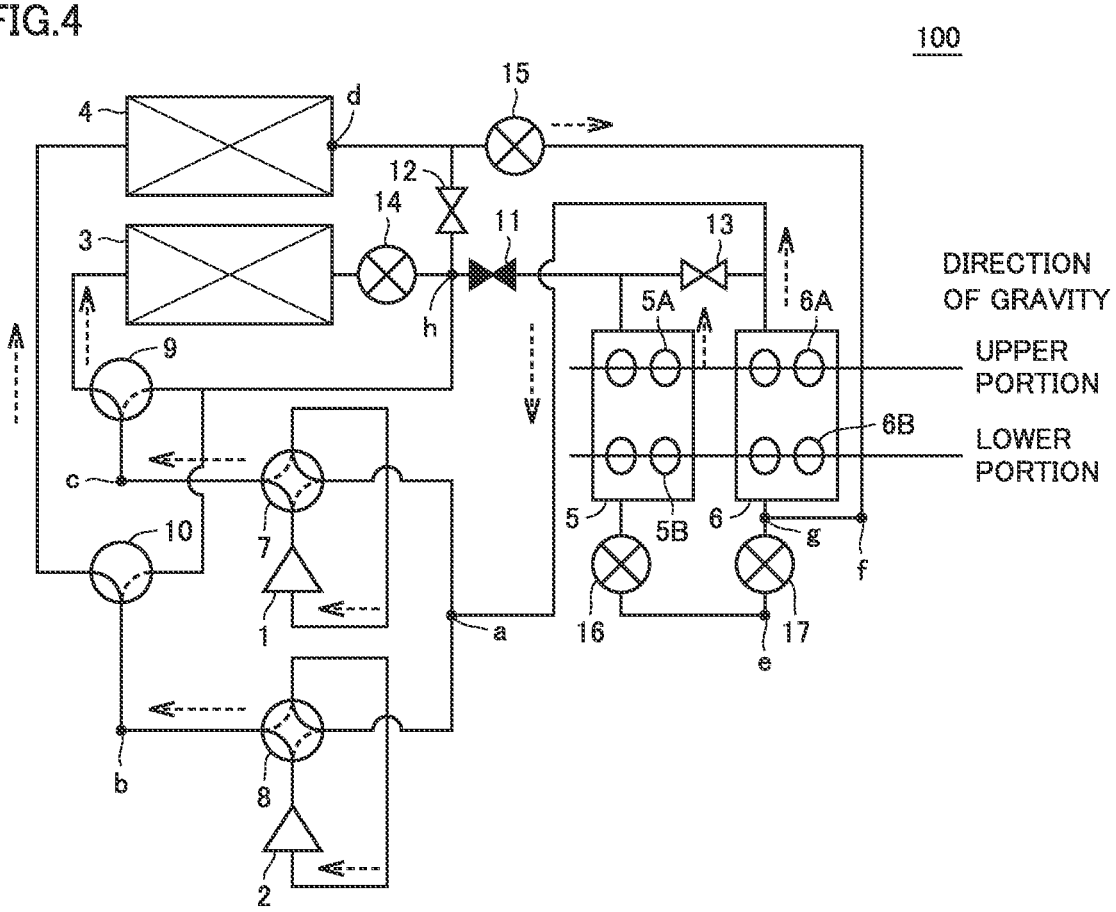
FIG. 4 shows a configuration of the refrigerant circuit during cooling-dedicated operation of the air conditioner according to Embodiment 1.

As shown in FIG. 4, in air conditioner 100 during cooling-dedicated operation, first compressor 1 and first outdoor heat exchanger 3 are connected through first three-way valve 9, and second compressor 2 and second outdoor heat exchanger 4 are connected through second three-way valve 10. In air conditioner 100 during cooling-dedicated operation, second expansion valve 14, second solenoid valve 12, first expansion valve 15, third solenoid valve 13, third expansion valve 16, and fourth expansion valve 17 are opened, and first solenoid valve 11 is closed. In air conditioner 100 during cooling-dedicated operation, accordingly, first compressor 1, first four-way valve 7, first three-way valve 9, first outdoor heat exchanger 3, second expansion valve 14, second solenoid valve 12, first expansion valve 15, and second indoor heat exchanger 6 are connected in series in order, and second compressor 2, second four-way valve 8, second three-way valve 10, second outdoor heat exchanger 4, first expansion valve 15, fourth expansion valve 17, third expansion valve 16, and first indoor heat exchanger 5 are connected in series in order. At this time, the only refrigerant flowing from first outdoor heat exchanger 3 to first indoor heat exchanger 5 or second indoor heat exchanger 6 circulates through the branch pipe having branch point h. During cooling-dedicated operation, the third refrigerant pipeline, fourth refrigerant pipeline, seventh refrigerant pipeline, and eighth refrigerant pipeline described above are opened to form a refrigerant flow path.

Figure 5:
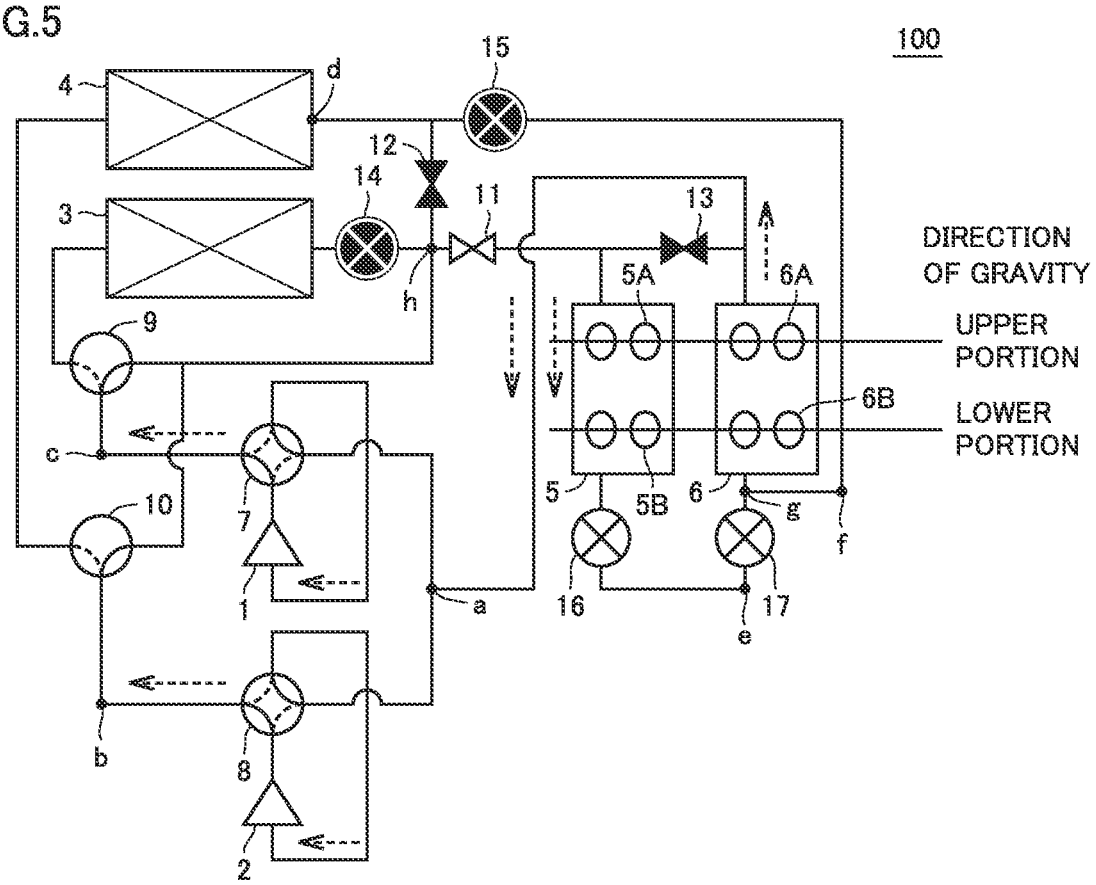
FIG. 5 shows a configuration of the refrigerant circuit during full heat recovery operation of the air conditioner according to Embodiment 1.
Figure 6:
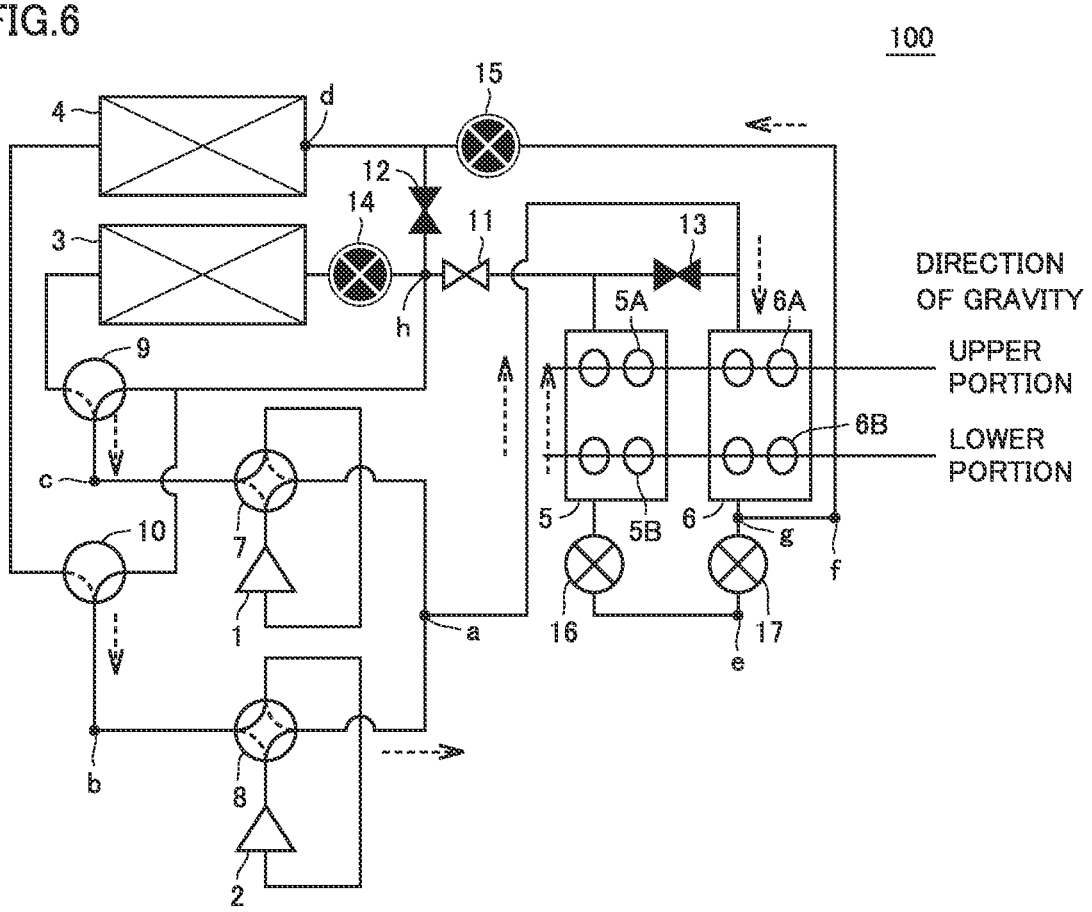
FIG. 6 shows a configuration of the refrigerant circuit during full heat recovery operation of the air conditioner according to Embodiment 1.

As shown in FIGS. 5 and 6, in air conditioner 100 during full heat recovery operation, first compressor 1 and first indoor heat exchanger 5 are connected through first three-way valve 9, and second compressor 2 and first indoor heat exchanger 5 are connected through second three-way valve 10. Further, first four-way valve 7 and second four-way valve 8 are controlled such that refrigerant circulates from one of first indoor heat exchanger 5 and second indoor heat exchanger 6, which acts as a condenser, to the other indoor heat exchanger which acts as an evaporator. As shown in FIG. 5, in air conditioner 100, during full heat recovery operation in which first indoor heat exchanger 5 acts as a condenser and second indoor heat exchanger 6 acts as an evaporator, first solenoid valve 11, third expansion valve 16, and fourth expansion valve 17 are opened, and second solenoid valve 12, third solenoid valve 13, first expansion valve 15, and second expansion valve 14 are closed. In air conditioner 100, accordingly, first compressor 1, first four-way valve 7, first three-way valve 9, first solenoid valve 11, first indoor heat exchanger 5, third expansion valve 16, fourth expansion valve 17, and second indoor heat exchanger 6 are connected in series in order, and second compressor 2, second four-way valve 8, second three-way valve 10, first solenoid valve 11, first indoor heat exchanger 5, third expansion valve 16, fourth expansion valve 17, and second indoor heat exchanger 6 are connected in series in order.

As shown in FIG. 6, in air conditioner 100 during full heat recovery operation in which first indoor heat exchanger 5 acts as an evaporator and second indoor heat exchanger 6 acts as a condenser, first solenoid valve 11, third expansion valve 16, and fourth expansion valve 17 are opened, and second solenoid valve 12, third solenoid valve 13, first expansion valve 15, and second expansion valve 14 are closed. In air conditioner 100, accordingly, first compressor 1, first four-way valve 7, second indoor heat exchanger 6, fourth expansion valve 17, third expansion valve 16, first indoor heat exchanger 5, first solenoid valve 11, and first three-way valve 9 are connected in series in order. In air conditioner 100, further, second compressor 2, second four-way valve 8, second indoor heat exchanger 6, fourth expansion valve 17, third expansion valve 16, first indoor heat exchanger 5, first solenoid valve 11, and second three-way valve 10 are connected in series in order. Refrigerant flowing between first three-way valve 9 and first indoor heat exchanger 5 and refrigerant flowing between second three-way valve 10 and first indoor heat exchanger 5 circulate through the branch pipe having branch point h.

Figure 7:
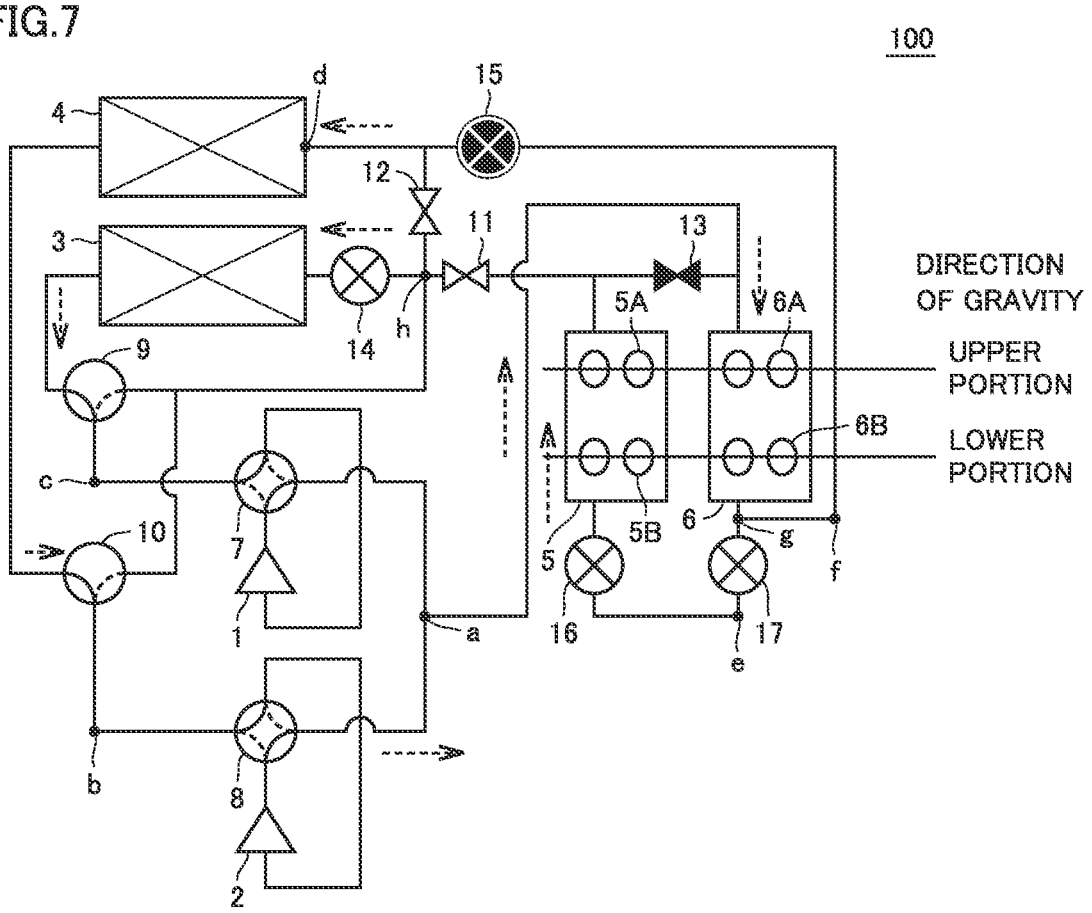
FIG. 7 shows a configuration of the refrigerant circuit during heating-based operation of the air conditioner according to Embodiment 1.

As shown in FIG. 7, in air conditioner 100 during heating-based operation in which first indoor heat exchanger 5 acts as an evaporator and second indoor heat exchanger 6 acts as a condenser (hereinafter, merely referred to as "during heating-based operation"), first compressor 1 and first outdoor heat exchanger 3 are connected through first three-way valve 9, and second compressor 2 and second outdoor heat exchanger 4 are connected through second three-way valve 10. In air conditioner 100 during heating-based operation, second expansion valve 14, first solenoid valve 11, second solenoid valve 12, third expansion valve 16, and fourth expansion valve 17 are opened, and first expansion valve 15 and third solenoid valve 13 are closed. In air conditioner 100 during heating-based operation, accordingly, first compressor 1, first four-way valve 7, second indoor heat exchanger 6, fourth expansion valve 17, third expansion valve 16, first indoor heat exchanger 5, first solenoid valve 11, second expansion valve 14, first outdoor heat exchanger 3, and first three-way valve 9 are connected in series in order, and first compressor 1, first four-way valve 7, second indoor heat exchanger 6, fourth expansion valve 17, third expansion valve 16, first indoor heat exchanger 5, first solenoid valve 11, second solenoid valve 12, second outdoor heat exchanger 4, and second three-way valve 10 are connected in series. Refrigerant flowing from first indoor heat exchanger 5 to first outdoor heat exchanger 3 and refrigerant flowing from first indoor heat exchanger 5 to second outdoor heat exchanger 4 circulate through the branch pipe having branch point h. During heating-based operation, the first refrigerant pipeline and the fifth refrigerant pipeline described above are opened to form a refrigerant flow path.

In air conditioner 100 during heating-based operation, further, second compressor 2, second four-way valve 8, second indoor heat exchanger 6, fourth expansion valve 17, third expansion valve 16, first indoor heat exchanger 5, first solenoid valve 11, second expansion valve 14, first outdoor heat exchanger 3, and first three-way valve 9 are connected in series in order, and second compressor 2, second four-way valve 8, second indoor heat exchanger 6, fourth expansion valve 17, third expansion valve 16, first indoor heat exchanger 5, first solenoid valve 11, second solenoid valve 12, second outdoor heat exchanger 4, and second three-way valve 10 are connected in series in order.

Figure 8:
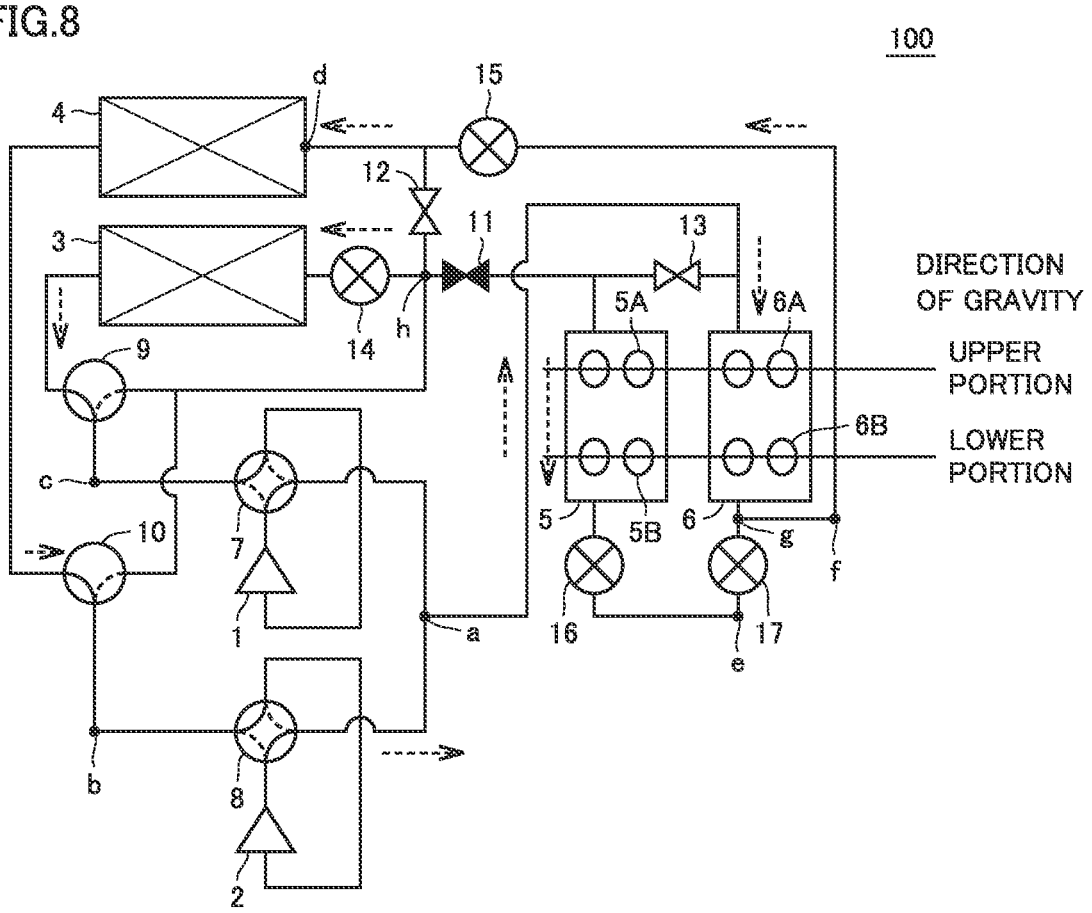
FIG. 8 shows a configuration of the refrigerant circuit during heating-dedicated operation of the air conditioner according to Embodiment 1.

As shown in FIG. 8, in air conditioner 100 during heating-dedicated operation, first compressor 1 and first outdoor heat exchanger 3 are connected through first three-way valve 9, and second compressor 2 and second outdoor heat exchanger 4 are connected through second three-way valve 10. In air conditioner 100 during heating-dedicated operation, first expansion valve 15, second expansion valve 14, first solenoid valve 11, third solenoid valve 13, third expansion valve 16, and fourth expansion valve 17 are opened, and second solenoid valve 12 is closed. In air conditioner 100 during heating-dedicated operation, accordingly, first compressor 1, first four-way valve 7, third solenoid valve 13, first indoor heat exchanger 5, third expansion valve 16, fourth expansion valve 17, first expansion valve 15, second solenoid valve 12, second expansion valve 14, first outdoor heat exchanger 3, and first three-way valve 9 are connected in series in order, and first compressor 1, first four-way valve 7, second indoor heat exchanger 6, first expansion valve 15, second solenoid valve 12, second expansion valve 14, first outdoor heat exchanger 3, and first three-way valve 9 are connected in series in order.

In air conditioner 100 during heating-dedicated operation, further, second compressor 2, second four-way valve 8, third solenoid valve 13, first indoor heat exchanger 5, third expansion valve 16, fourth expansion valve 17, first expansion valve 15, second outdoor heat exchanger 4, and second three-way valve 10 are connected in series in order, and second compressor 2, second four-way valve 8, second indoor heat exchanger 6, first expansion valve 15, second outdoor heat exchanger 4, and second three-way valve 10 are connected in series in order. Only the refrigerant flowing from second indoor heat exchanger 6 to first outdoor heat exchanger 3 or to second outdoor heat exchanger 4 circulates through the branch pipe having branch point h. During heating-dedicated operation, the third refrigerant pipeline, fourth refrigerant pipeline, seventh refrigerant pipeline, and eighth refrigerant pipeline described above are opened to form a refrigerant flow path.

As described above, air conditioner 100 can control opening/closing of first four-way valve 7, second four-way valve 8, first three-way valve 9, second three-way valve 10, first expansion valve 15, second expansion valve 14, first solenoid valve 11, second solenoid valve 12, and third solenoid valve 13 to switch among the first state of the cooling-based operation, the second state of the cooling-based operation, the cooling-dedicated operation, the full heat recovery operation, the heating-based operation, and the heating-dedicated operation.

Embodiment 2

Figure 9:
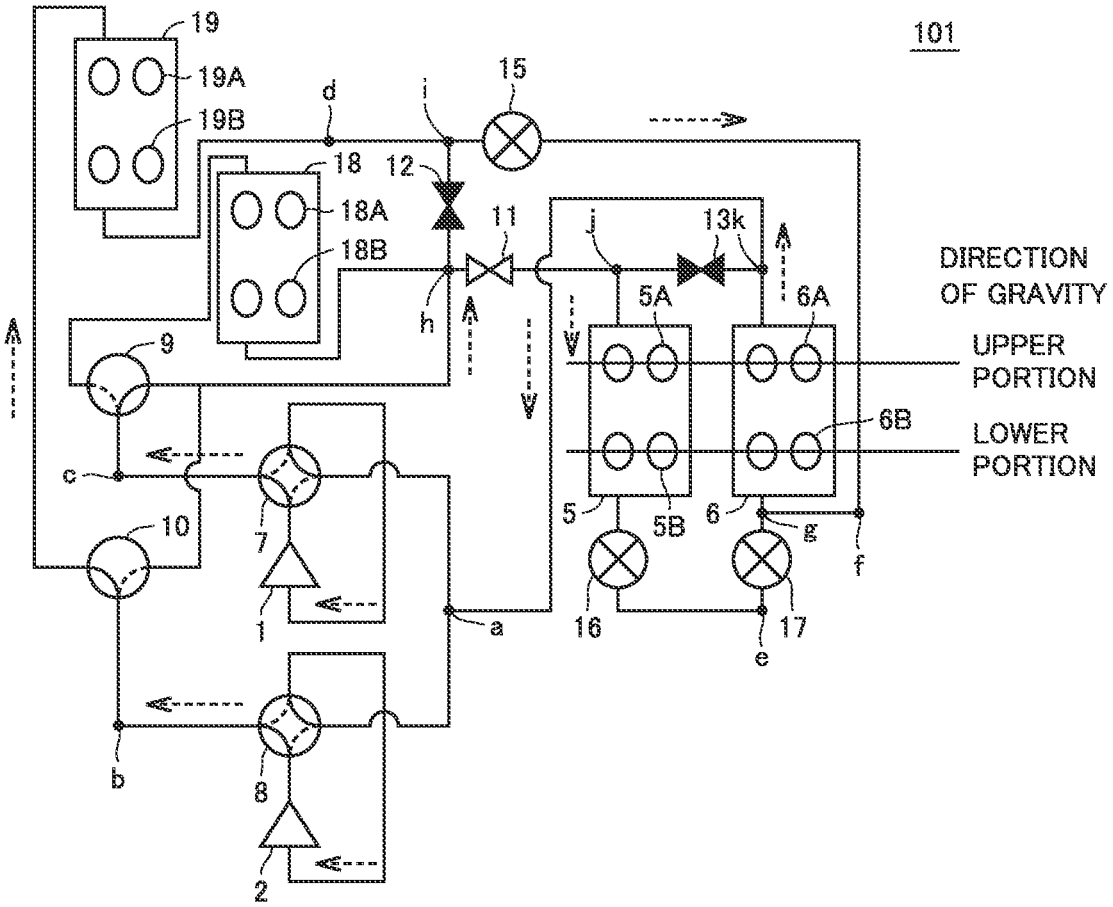
FIG. 9 shows a configuration of a refrigerant circuit in a second state during cooling-based operation on a low outdoor temperature condition of an air conditioner according to Embodiment 2.

An air conditioner 101 according to Embodiment 2 will now be described with reference to FIG. 9. Air conditioner 101 basically has a configuration similar to that of air conditioner 100 according to Embodiment 1 but differs therefrom in that it includes a first outdoor heat exchanger 18 and a second outdoor heat exchanger 19 that are water-heat exchangers that perform heat exchange between water and refrigerant, in place of first outdoor heat exchanger 3 and second outdoor heat exchanger 4 that are air-heat exchangers that perform heat exchange between air and refrigerant.

First outdoor heat exchanger 18 includes a refrigerant inlet/outlet 18A and a refrigerant inlet/outlet 18B, which are located in an upper portion and a lower portion, respectively, in the direction of gravity. Second outdoor heat exchanger 19 includes a refrigerant inlet/outlet 18B and a refrigerant inlet/outlet 19B, which are located in an upper portion and a lower portion, respectively, in the direction of gravity. Refrigerant inlet/outlet 18A is connected through first three-way valve 9 and first four-way valve 7 to the discharge side of first compressor 1. Refrigerant inlet/outlet 19A is connected through second three-way valve 10 and second four-way valve 8 to the discharge side of second compressor 2. Refrigerant inlet/outlet 18B is connected to refrigerant inlet/outlet 5A (the inflow side during cooling-based operation) of first indoor heat exchanger 5. Refrigerant inlet/outlet 19B is connected through first solenoid valve 11 to refrigerant inlet/outlet 5A of first indoor heat exchanger 5. Refrigerant inlet/outlet 19B is connected through first expansion valve 15 to refrigerant inlet/outlet 6B (the inflow side during cooling-based operation) of second indoor heat exchanger 6.

Air conditioner 101 may include no second expansion valve 14 (see FIG. 1) of air conditioner 100. In other words, air conditioner 101 may include no open/close valve for opening and closing a refrigerant flow path between refrigerant inlet/outlet 18B of first outdoor heat exchanger 18 and four-branch point h.

In air conditioner 101 in the first state, first compressor 1, first four-way valve 7, first three-way valve 9, first outdoor heat exchanger 18, first indoor heat exchanger 5, third expansion valve 16, fourth expansion valve 17, and second indoor heat exchanger 6 are connected in series in order. In air conditioner 101 in the first state, further, second compressor 2, second four-way valve 8, second three-way valve 10, second outdoor heat exchanger 19, second solenoid valve 12, first solenoid valve 11, first indoor heat exchanger 5, third expansion valve 16, fourth expansion valve 17, and second indoor heat exchanger 6 are connected in series in order.

In air conditioner 101 in the second state, first compressor 1, first four-way valve 7, first three-way valve 9, first solenoid valve 11, first indoor heat exchanger 5, third expansion valve 16, fourth expansion valve 17, and second indoor heat exchanger 6 are connected in series in order. In air conditioner 101 in the second state, further, second compressor 2, second four-way valve 8, second three-way valve 10, second outdoor heat exchanger 19, first expansion valve 15, and second indoor heat exchanger 6 are connected in series in order.

Also in the above configuration, air conditioner 101 basically has a configuration similar to that of air conditioner 100, and accordingly, can achieve effects similar to those of air conditioner 100. Air conditioner 101 further includes first outdoor heat exchanger 18 and second outdoor heat exchanger 19 that are water-heat exchangers. Compared with an air-heat exchanger, a water-heat exchanger normally has a small amount of refrigerant (stagnation amount of refrigerant) accumulated while being in nonoperation status. Consequently, air conditioner 101, which does not include second expansion valve 14 unlike air conditioner 100, is prevented from experiencing a lack of circulation amount of refrigerant associated with an increase in the stagnation amount of refrigerant, and thus, has air conditioning performance whose decrease is suppressed also in the second state in which first outdoor heat exchanger 18 is in the nonoperation status.

Air conditioner 100, 101 may include a plurality of first indoor heat exchangers 5 and a plurality of second indoor heat exchangers 6. It suffices that in this case, first indoor heat exchangers 5 are connected to each other in parallel. It also suffices that second indoor heat exchangers 6 are connected to each other in parallel. Such air conditioner 100, 101 includes a plurality of refrigerant circuits, in each of which first compressor 1, first four-way valve 7, first three-way valve 9, first outdoor heat exchanger 3 (first outdoor heat exchanger 18), second expansion valve 14, first solenoid valve 11, first indoor heat exchanger 5, third expansion valve 16, fourth expansion valve 17, and second indoor heat exchanger 6 are connected in series in order in the first state. Air conditioner 100, 101 includes a plurality of refrigerant circuits, in each of which second compressor 2, second four-way valve 8, second three-way valve 10, second outdoor heat exchanger 4 (second outdoor heat exchanger 19), second solenoid valve 12, first solenoid valve 11, first indoor heat exchanger 5, third expansion valve 16, fourth expansion valve 17, and second indoor heat exchanger 6 are connected in series in order in the first state. Air conditioner 100, 101 further includes a plurality of refrigerant circuits, in each of which first compressor 1, first four-way valve 7, first three-way valve 9, first solenoid valve 11, first indoor heat exchanger 5 (first outdoor heat exchanger 18), third expansion valve 16, fourth expansion valve 17, and second indoor heat exchanger 6 are connected in series in order in the second state. Air conditioner 100, 101 includes a plurality of refrigerant circuits, in each of which second compressor 2, second four-way valve 8, second three-way valve 10, second outdoor heat exchanger 4 (second outdoor heat exchanger 19), first expansion valve 15, and second indoor heat exchanger 6 are connected in series in order in the second state.

The switch mechanism in air conditioner 100, 101 is not limited to first three-way valve 9 and may be formed of a plurality of open/close valves. For example, in air conditioner 100, 101, the switch mechanism may include a first open/close valve, which is capable of stopping a refrigerant flow path formed in the first state from the discharge side of first compressor 1 to first outdoor heat exchanger 3, and a second open/close valve, which is capable of stopping a refrigerant flow path formed in the second state from the discharge side of the first compressor to first indoor heat exchanger 5. In this case, in the second state, the first open/close valve is closed, and the second open/close valve is opened. This stops a refrigerant flow from first compressor 1 to first outdoor heat exchanger 3 and circulates refrigerant from first compressor 1 to first indoor heat exchanger 5 in the second state. Consequently, the refrigerant discharged from first compressor 1 can flow through first indoor heat exchanger 5, third expansion valve 16, fourth expansion valve 17, and second indoor heat exchanger 6 in order while bypassing first outdoor heat exchanger 3 and second outdoor heat exchanger 4.

Although the embodiments of the present invention have been described above, the embodiments above can be modified variously. It is therefore intended that the scope of the present invention is defined by claims, not only by the embodiments described above, and encompasses all modifications and variations equivalent in meaning and scope to the claims.

The invention claimed is:

1. An air conditioner configured to perform a simultaneous cooling and heating operation, the air conditioner comprising a refrigeration cycle having a refrigeration circuit in which a first compressor and a second compressor are connected in parallel, the first compressor, the second compressor, a first outdoor heat exchanger, a second outdoor heat exchanger, a first indoor heat exchanger, a second indoor heat exchanger, and an expansion valve being connected by pipelines, wherein when the air conditioner is operated in a first operation mode in which the second outdoor heat exchanger and the first indoor heat exchanger are operated as condensers and the second indoor heat exchanger is operated as an evaporator, refrigerant discharged from the first compressor flows through the first indoor heat exchanger, the expansion valve, and the second indoor heat exchanger while bypassing the first outdoor heat exchanger and the second outdoor heat exchanger in order, and refrigerant discharged from the second compressor flows through the second outdoor heat exchanger and then flows through the second indoor heat exchanger while bypassing the first indoor heat exchanger, wherein when the air conditioner is operated in a second operation mode in which the first outdoor heat exchanger, the second outdoor heat exchanger, and the first indoor heat exchanger are operated as condensers and the second indoor heat exchanger is operated as an evaporator, refrigerant discharged from the first compressor flows through the first outdoor heat exchanger, the first indoor heat exchanger, the expansion valve, and the second indoor heat exchanger in order, and refrigerant discharged from the second compressor flows through the second outdoor heat exchanger, the first indoor heat exchanger, the expansion valve, and the second indoor heat exchanger in order, wherein when an outdoor air temperature where the first outdoor heat exchanger is placed is lower than a threshold, the air conditioner is operated in the first operation mode, wherein in the first operation mode, a flow of the refrigerant from the first outdoor heat exchanger to the first indoor heat exchanger is stopped, a flow of the refrigerant from the second outdoor heat exchanger to the first indoor heat exchanger is stopped, and the refrigerant flows from the second outdoor heat exchanger to the second indoor heat exchanger, wherein when the outdoor air temperature where the first outdoor heat exchanger is placed is higher than or equal to the threshold, the air conditioner is operated in the second operation mode, and wherein in the second operation mode, a flow of the refrigerant from the second outdoor heat exchanger to the second indoor heat exchanger is stopped, the refrigerant flows from the first outdoor heat exchanger to the first indoor heat exchanger, and the refrigerant flows from the second outdoor heat exchanger to the first indoor heat exchanger, and wherein the air conditioner further comprises:

a valve configured to switch between a flow of the refrigerant which is formed in the second operation mode from the first compressor to the first outdoor heat exchanger and a flow of the refrigerant which is formed in the first operation mode from the first compressor to the first indoor heat exchanger; and a first valve configured to stop a flow of the refrigerant which is formed in the second operation mode from the second outdoor heat exchanger to the first indoor heat exchanger.

2. The air conditioner according to claim 1, further comprising a second valve configured to stop a flow of the refrigerant which is formed in the first operation mode from the second outdoor heat exchanger to the second indoor heat exchanger.

3. The air conditioner according to claim 1, wherein the first outdoor heat exchanger is an air-heat exchanger configured to perform heat exchange between air and refrigerant, and wherein the air conditioner further comprises a third valve configured to stop a flow of the refrigerant which is formed in the second operation mode from the first outdoor heat exchanger to the first indoor heat exchanger.

* * * * *